US010350741B2

(12) United States Patent
Brendel et al.

(10) Patent No.: US 10,350,741 B2
(45) Date of Patent: Jul. 16, 2019

(54) POWERED NAIL DRIVER WITH A NAIL PLACEMENT ASSEMBLY

(71) Applicant: Black & Decker Inc., New Britain, CT (US)

(72) Inventors: Lee M. Brendel, Bel Air, MD (US); Larry E. Gregory, Baltimore, MD (US); Rex A. Marshall, Jr., White Marsh, MI (US)

(73) Assignee: Black & Decker Inc., New Britain, CT (US)

( * ) Notice: Subject to any disclaimer, the term of this patent is extended or adjusted under 35 U.S.C. 154(b) by 333 days.

(21) Appl. No.: 15/339,543

(22) Filed: Oct. 31, 2016

(65) Prior Publication Data

US 2017/0120432 A1 May 4, 2017

Related U.S. Application Data

(60) Provisional application No. 62/249,648, filed on Nov. 2, 2015.

(51) Int. Cl.
*B25C 1/06* (2006.01)
*B25C 1/00* (2006.01)
(Continued)

(52) U.S. Cl.
CPC ..... *B25C 1/008* (2013.01); *B25C 1/001* (2013.01); *B25C 1/06* (2013.01); *B25C 1/188* (2013.01);
(Continued)

(58) Field of Classification Search
CPC ..... B25C 1/001; B25C 1/005; B25C 1/008; B25C 1/18; B25C 1/184; B25C 1/04;
(Continued)

(56) References Cited

U.S. PATENT DOCUMENTS 3,134,981 A * 6/1964 Demetrakopoulos ... B25C 1/001 227/112
3,398,446 A * 8/1968 Karlsson ..... B29D 30/66 227/149
(Continued)

FOREIGN PATENT DOCUMENTS

CN 10205531 A 5/2011
DE 3715293 A1 1/1988
(Continued)

OTHER PUBLICATIONS

Extended European Search Report dated Jun. 9, 2017 in corresponding EP Patent Application No. 16196931.

*Primary Examiner* — Scott A Smith
(74) *Attorney, Agent, or Firm* — Harness, Dickey & Pierce, PLC

(57) ABSTRACT

A replaceable positioning tip can be removably fixedly coupled to a distal end of the trip arm. The positioning tip can define a tip nail guide groove having a proximal portion extending at a first angle substantially parallel to a nail driver axis and a distal end tapering at a second angle. The tapered distal end can be encompassed by a thin-walled portion. A nail tip lifter can be coupled to the rear nail guide housing for pivotable movement between a first position adjacent the positioning tip and a second position away from the positioning tip. The nail tip lifter can define a lifter nail guide groove extending from its inception at a proximal end to a distal end. A biasing member can be positioned between the rear nail guide housing and the nail tip lifter to bias the nail tip lifter toward the first position.

20 Claims, 11 Drawing Sheets

(51) Int. Cl.
*B25C 1/18* (2006.01)
*B25C 7/00* (2006.01)
*B25C 5/16* (2006.01)

(52) U.S. Cl.
CPC ..... *B25C 1/00* (2013.01); *B25C 5/16* (2013.01); *B25C 7/00* (2013.01)

(58) Field of Classification Search
CPC .. B25C 1/047; B25C 5/16; B25C 1/00; B25C 1/02; B25C 1/041; B25C 7/00
USPC ... 227/119, 120, 8, 130, 147, 138, 148, 136, 227/112, 10, 149
See application file for complete search history.

(56) References Cited

U.S. PATENT DOCUMENTS 3,854,648 A * 12/1974 Inzoli ..... B25C 1/003 227/130
4,065,045 A * 12/1977 Pray ..... B25C 1/02 227/147
4,195,762 A * 4/1980 Burton ..... A47C 31/026 227/149
5,238,167 A 8/1993 Howard et al.
5,452,835 A 9/1995 Shkolnikov
5,810,239 A * 9/1998 Stich ..... B25C 7/00 227/119
6,279,808 B1 * 8/2001 Larsen ..... B25C 1/00 227/119
6,286,742 B1 * 9/2001 Mukoyama ..... B25C 1/00 227/148
6,739,490 B1 5/2004 Shkolnikov et al.
6,789,718 B2 9/2004 Canlas et al.
6,808,101 B2 * 10/2004 Laubach ..... B25C 1/005 227/109
6,820,788 B2 * 11/2004 Akiba ..... B25C 1/008 227/130
7,017,790 B1 * 3/2006 Peng ..... B25C 1/188 227/107
7,172,103 B2 * 2/2007 Fujiyama et al. .... B25B 23/045 227/107
RE39,567 E 4/2007 Larsen
7,255,256 B2 * 8/2007 McGee ..... B25C 1/041 227/119
7,516,876 B2 4/2009 Ohmori
7,628,304 B2 * 12/2009 Yamamoto ..... B25C 1/008 227/119
RE41,265 E 4/2010 Perra et al.
7,998,289 B2 8/2011 Brodt et al.
8,220,687 B2 7/2012 Yamamoto et al.
9,527,196 B2 * 12/2016 Segura ..... B25C 1/005
2008/0277446 A1 * 11/2008 Yamamoto ..... B25C 1/008 227/139
2009/0057366 A1 5/2009 Braddock
2010/0206934 A1 * 8/2010 Vallon ..... B25C 1/005 227/109
2011/0062209 A1 3/2011 Vallon et al.
2015/0093592 A1 4/2015 Smith

FOREIGN PATENT DOCUMENTS

EP 1741519 A1 10/2007
JP S5648482 U 4/1981
TW 201431656 A 8/2014
WO WO 2012/065090 A1 5/2012

* cited by examiner

POWERED NAIL DRIVER WITH A NAIL PLACEMENT ASSEMBLY

CROSS-REFERENCE TO RELATED APPLICATIONS

This application claims the benefit of U.S. Provisional Application No. 62/249,648, filed on Nov. 2, 2015. The entire disclosure of the above application is incorporated herein by reference.

FIELD

The present disclosure relates generally to the field of powered nail drivers, and more particularly to a cordless or battery-powered nail driver nail with a nail placement or positioning assembly for use in construction framing.

BACKGROUND

This section provides background information related to the present disclosure which is not necessarily prior art.

There is a need in construction framing to use battery-powered framing nailers to precisely fasten metal joist hangers, metal hurricane ties, strappings, and other metal components to framing members. Fastening such metal components involves driving the nail through a nail opening in the metal component. Typically, powered framing nailers tend to obscure the nail opening, which makes it very difficult to properly align the nail ejection opening of the nailer with the nail opening.

SUMMARY

This section provides a general summary of the disclosure, and is not a comprehensive disclosure of its full scope or all of its features.

In accordance with one aspect of the present disclosure, a nail driving tool with a nail placement or positioning assembly is provided. The nail placement assembly can have a nose housing assembly including a forward nail guide housing coupled to a rear nail guide housing and defining a nail driving path therebetween. A nail driver can be positioned and reciprocally movably along a nail driver axis to drive a nail down the nail driving path. A trip arm can be movably coupled to the nose housing assembly and movable between an extended non-trip position and a retracted trip position. A replaceable positioning tip can be removably fixedly coupled to a distal end of the trip arm. The replaceable positioning tip can define a tip nail guide groove having a proximal portion extending a first angle that is substantially parallel to the nail driver axis and a tapered distal end tapering at a second angle. The tapered distal end can be encompassed by a thin-walled portion of the replaceable positioning tip. A nail tip lifter can be pivotably coupled to the rear nail guide housing for pivotable movement between a first position adjacent the positioning tip and a second position away from the positioning tip. The nail tip lifter can define a lifter nail guide groove extending from a proximal end to a distal end of the lifter nail guide groove. A biasing member can be positioned between the rear nail guide housing and the nail tip lifter to bias the nail tip lifter toward the first position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
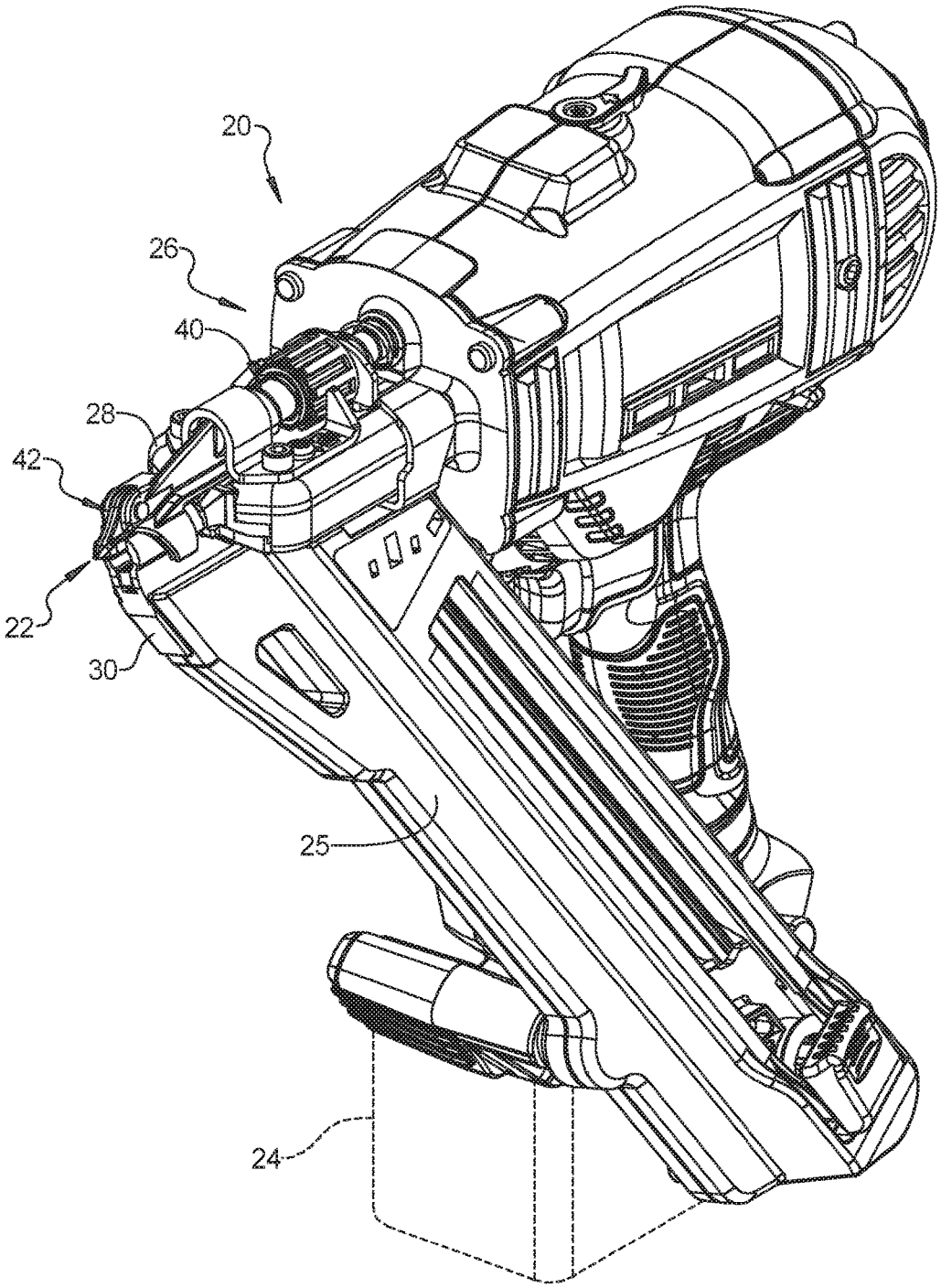
FIG. 1 is one example of a powered nail driver with a nail placement or positioning assembly in accordance with the present disclosure.
Figure 2:
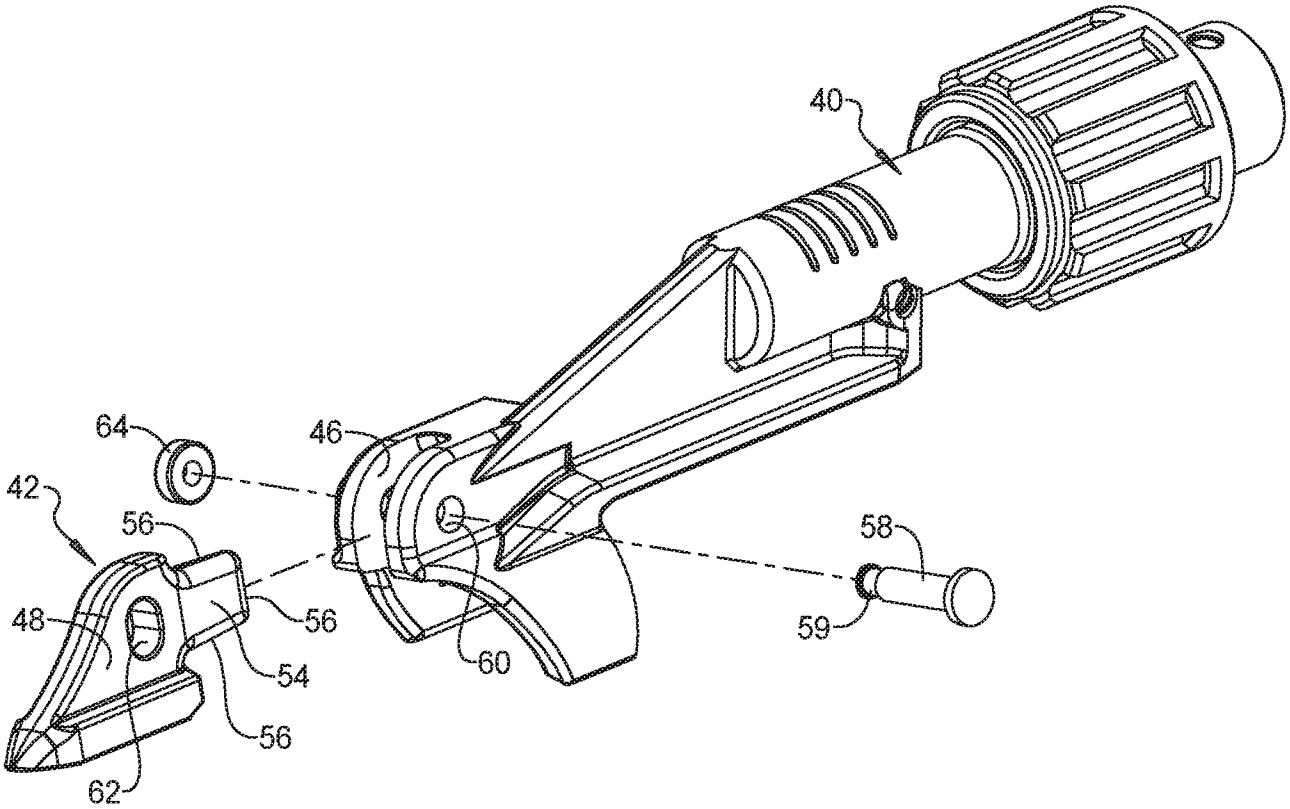
FIG. 2 is an exploded perspective view of the trip arm and positioning tip of the powered nail driver of FIG. 1.
Figure 3:
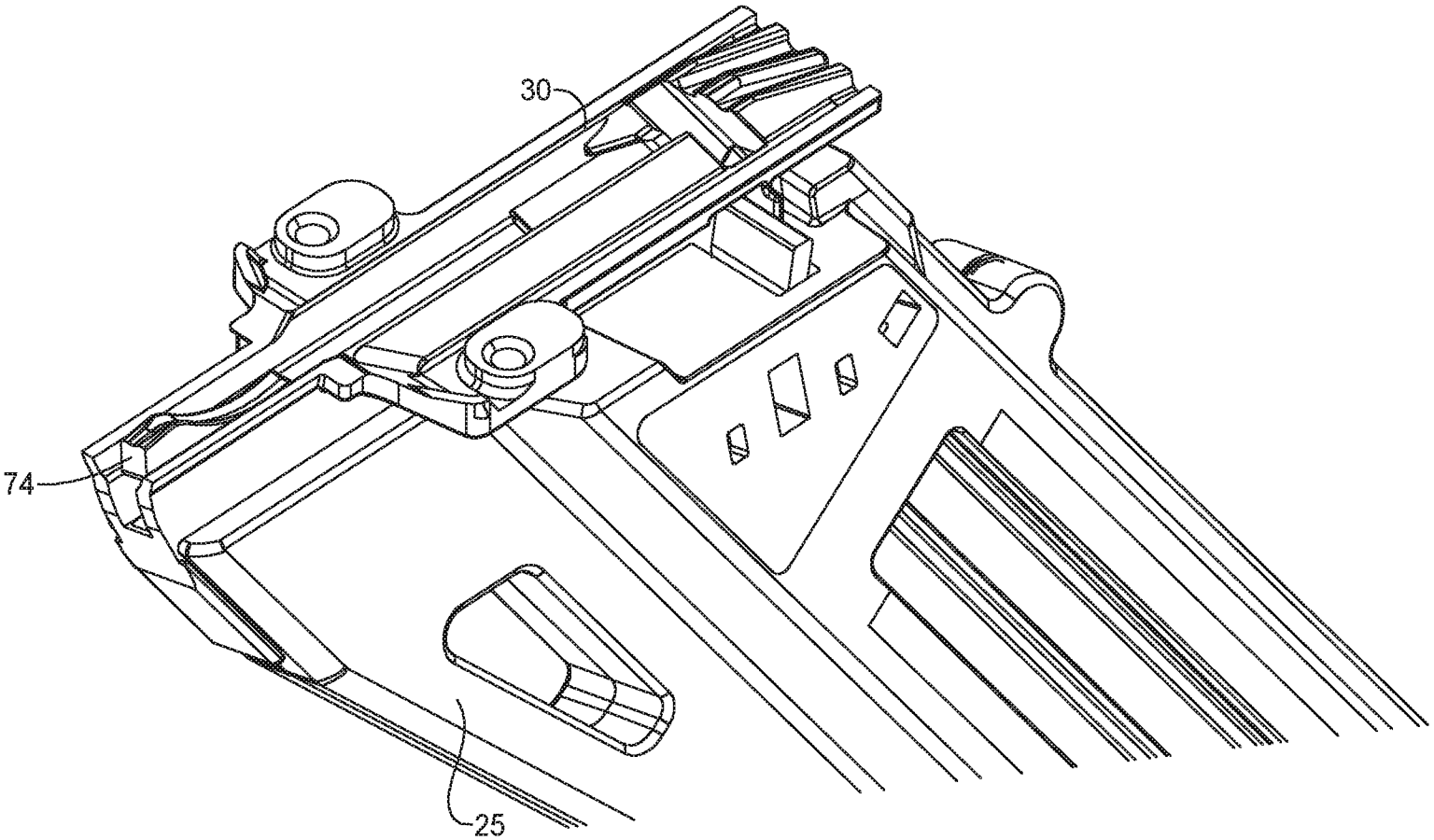
FIG. 3 is a perspective view of the rear nail guide housing and magazine of the powered nail driver of FIG. 1.
Figure 4:
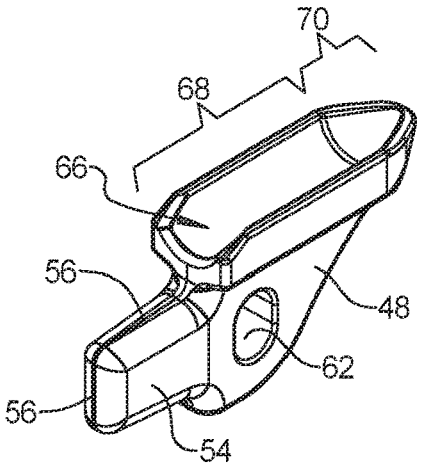
FIG. 4 is a perspective view of the replaceable positioning tip of the powered nail driver of FIG. 1.
Figure 5:
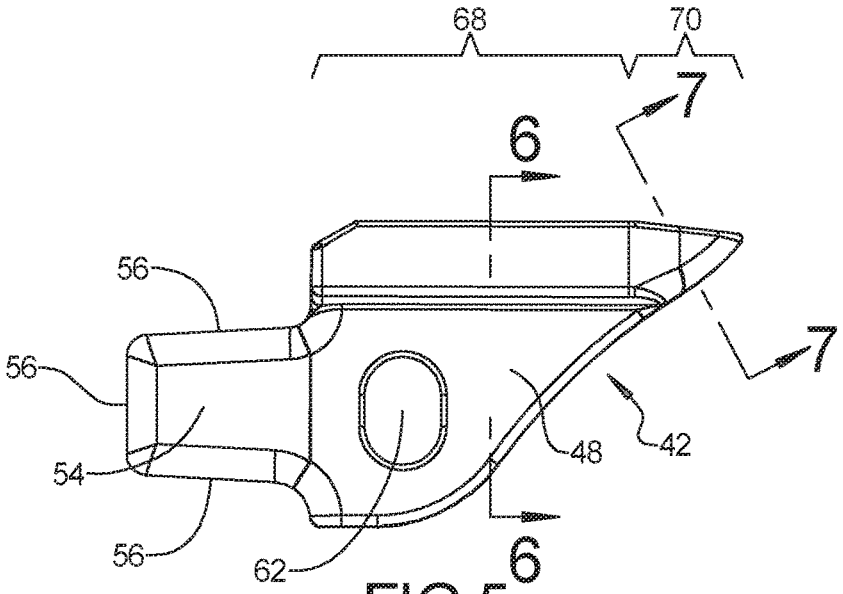
FIG. 5 is a side elevation view of the replaceable positioning tip of FIG. 4.
Figure 6:
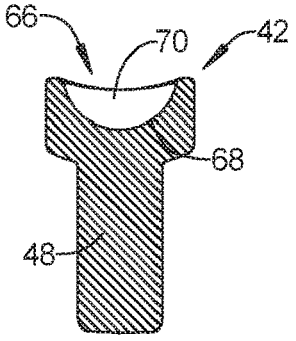
FIG. 6 is a cross section view taken along line 6-6 FIG. 5.
Figure 7:
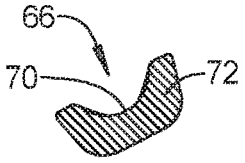
FIG. 7 is a cross section view taken along line 7-7 FIG. 5.
Figure 8:
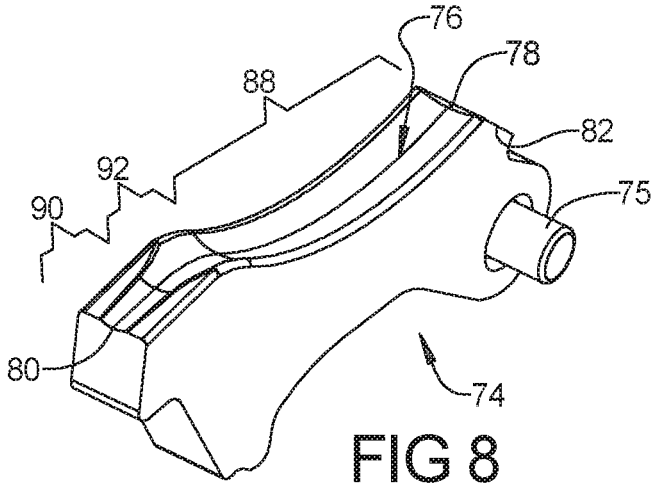
FIG. 8 is a perspective view of the nail tip lifter of the powered nail driver of FIG. 1.

Example embodiments will now be described more fully with reference to the accompanying drawings. While aspects of the present disclosure are described herein and illustrated in the accompanying drawings in the context of a battery-powered framing nailer, those of ordinary skill in the art will appreciate that the invention, in its broadest aspects, has further applicability.

FIGS. 1-13 relate to one example embodiment of a nail driving tool 20 with a nail placement or positioning assembly 22 in accordance with the present disclosure. The nail driving tool 20 can be a framing nailer. Additionally or alternatively, the nail driving tool 20 can be a cordless nailer powered by a portable battery 24. The battery 24 can be a 40 volt or greater battery, a 60 volt or greater battery, or even an 80 volt or greater battery.

The nail placement assembly 22 can include a nose housing assembly 26 including a forward nail guide housing 28 coupled to a rear nail guide housing 30 and defining a nail driving path 32 therebetween. A nail driver 34 is positioned and reciprocally movably along a nail driver axis 36 to drive a nail 38 down the nail driving path 32. A magazine 25 for successively feeding nails 38 to the nose housing assembly 26 can be coupled to the rear nail guide housing 30.

Figure 9:
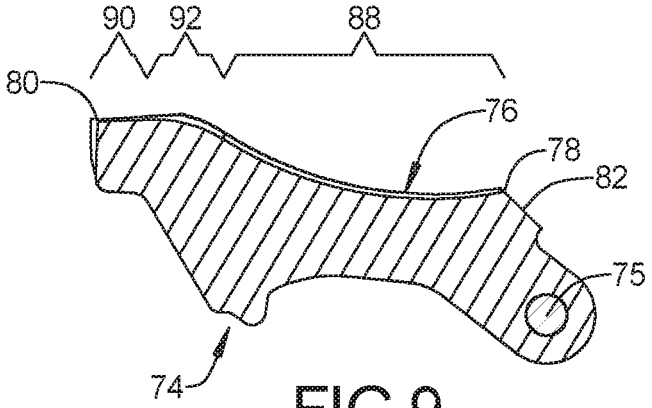
FIG. 9 is a cross section view of the nail tip lifter of FIG. 8.
Figure 10:
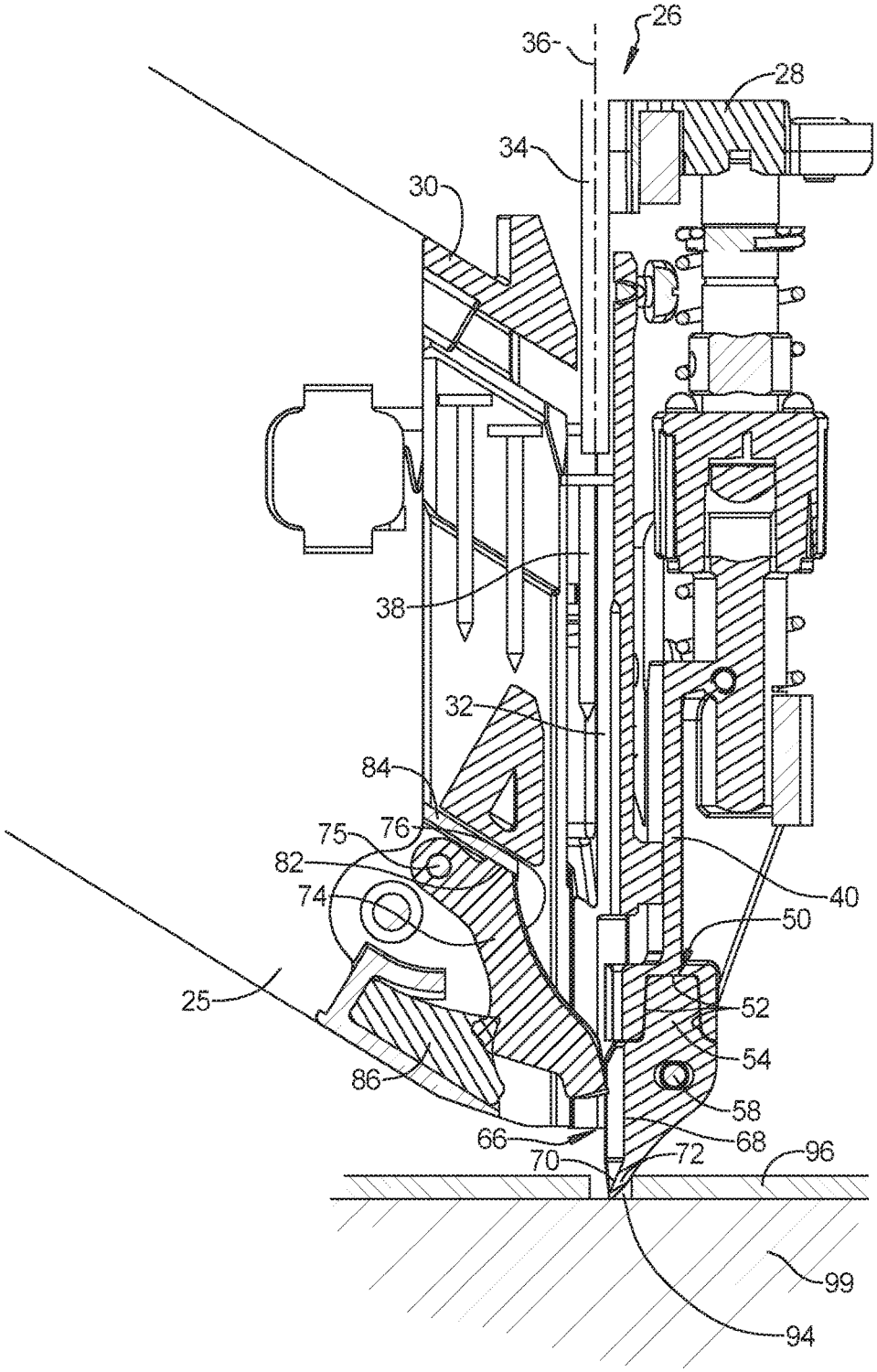
FIG. 10 is a cross section view including the nail placement or positioning assembly of FIG. 1, showing the positioning tip located within an aperture of a metal framing component and with the trip arm in the extended, non-trip position.

A trip arm 40 can be movably coupled to the nose housing assembly 26 and movable between an extended non-trip position (FIG. 9) and a retracted trip position (FIG. 10). A replaceable positioning tip 42 can be removably fixedly coupled to a distal end 44 of the trip arm 40. For example, the replaceable positioning tip 42 can include a flat extension 48 which can further include an extending tab 54 defined or bounded by three positioning sides or surfaces 56.

The distal end 44 of the trip arm 40 can include a tip-receiving channel 46 into which the flat extension 48 of the positioning tip 42 can be friction fit with the cooperating positioning surfaces 52, 56 engaged against each other. The tip-receiving channel 46 can further include a tab slot 50 defined or bounded by three positioning sides or surfaces 52. A removable pin 58 can extend through apertures 60 through the tip-receiving channel 46 of the trim arm 40 aligned with an aperture 62 of the extension 48 of the positioning tip 42.

A rubber grommet 64 or other removable fastener can be mounted on the pin 58 to selectively retain the pin 58 in the apertures 60, 62. When inserted, the pin 58 retains the cooperating positioning surfaces 52, 56 against each other. As a result, the positioning tip 42 can be fixedly coupled to the trip arm 40 for movement therewith, and without relative movement therebetween.

The replaceable positioning tip 42 can define a tip nail guide groove 66 having a proximal portion 68 and a tapered distal end 70. The proximal portion 68 of the tip nail guide groove 66 can extend at a first angle that is substantially parallel to the nail driver axis 36. The tapered distal end 70 of the tip nail guide groove 66 can taper at a second angle relative to the nail driver axis 36. In some cases, this second angle of the tapered distal end 70 of the tip nail guide groove 66 can be from about 5 degrees to about 8 degrees relative to the nail driver axis 36.

The tapered distal end 70 of the tip nail guide groove 66 can be encompassed by a thin-walled portion 72 of the replaceable positioning tip 42. The thickness of the thin-walled portion 72 encompassing the tapered distal end 70 and adjacent the proximal portion can be about equal to or less than a maximum depth of the proximal portion 68 of the tip nail guide groove 66.

The thickness of the thin-walled portion 72 encompassing the tapered distal end 70 can taper from a first thickness adjacent the proximal portion 68 of the tip nail guide groove 66 to a second thickness away from the proximal portion 68 that is smaller than the first thickness. An axial length of the tapered distal end 70 of the tip nail guide groove 66 can be less than about 25% of an aligned axial length of the proximal portion 68 of the tip nail guide groove 66.

Figure 13:
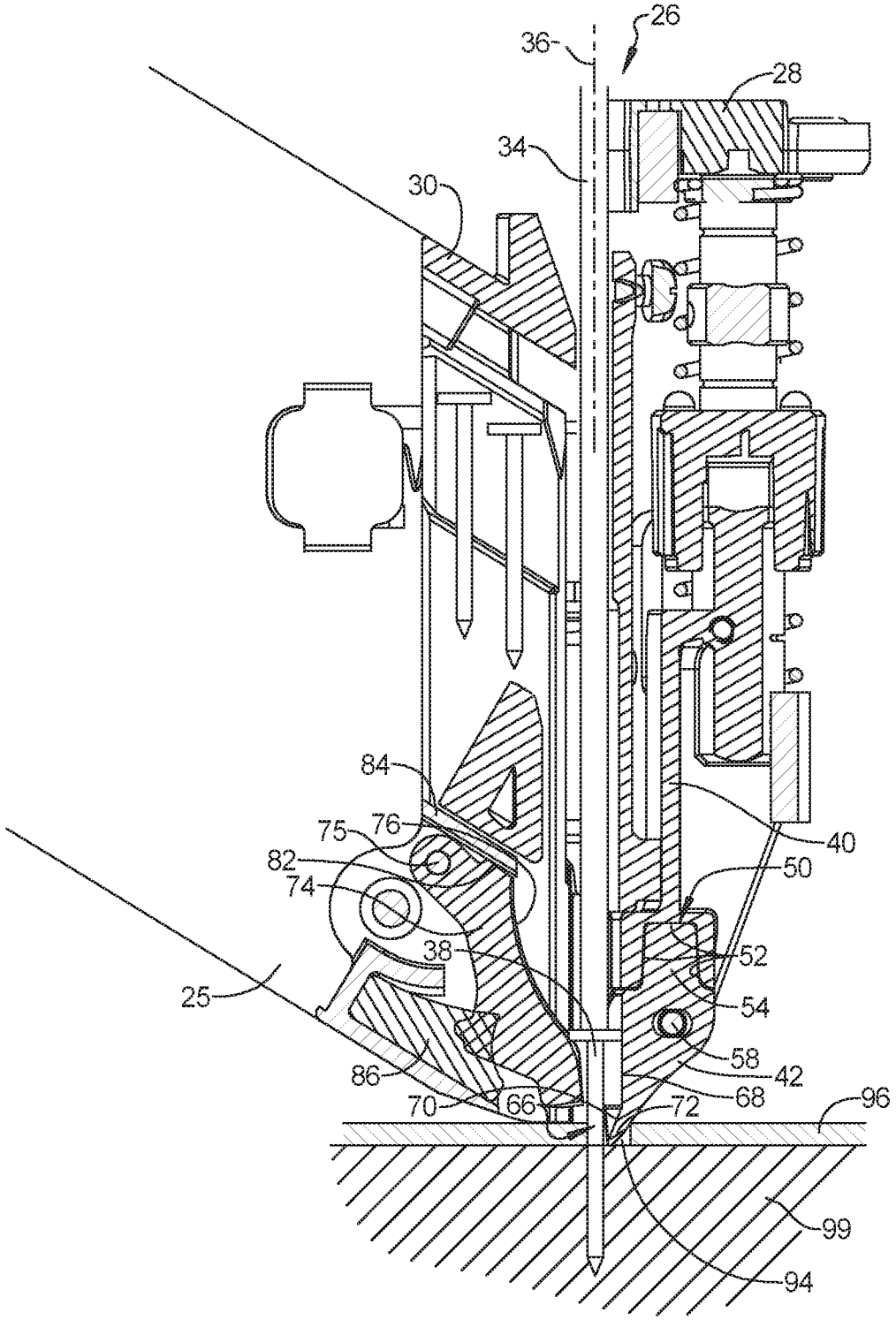
FIG. 13 is a cross section view similar to FIG. 12, but showing the nail head and/or nail driver initially engaging the nail tip lifter.
Figure 14:
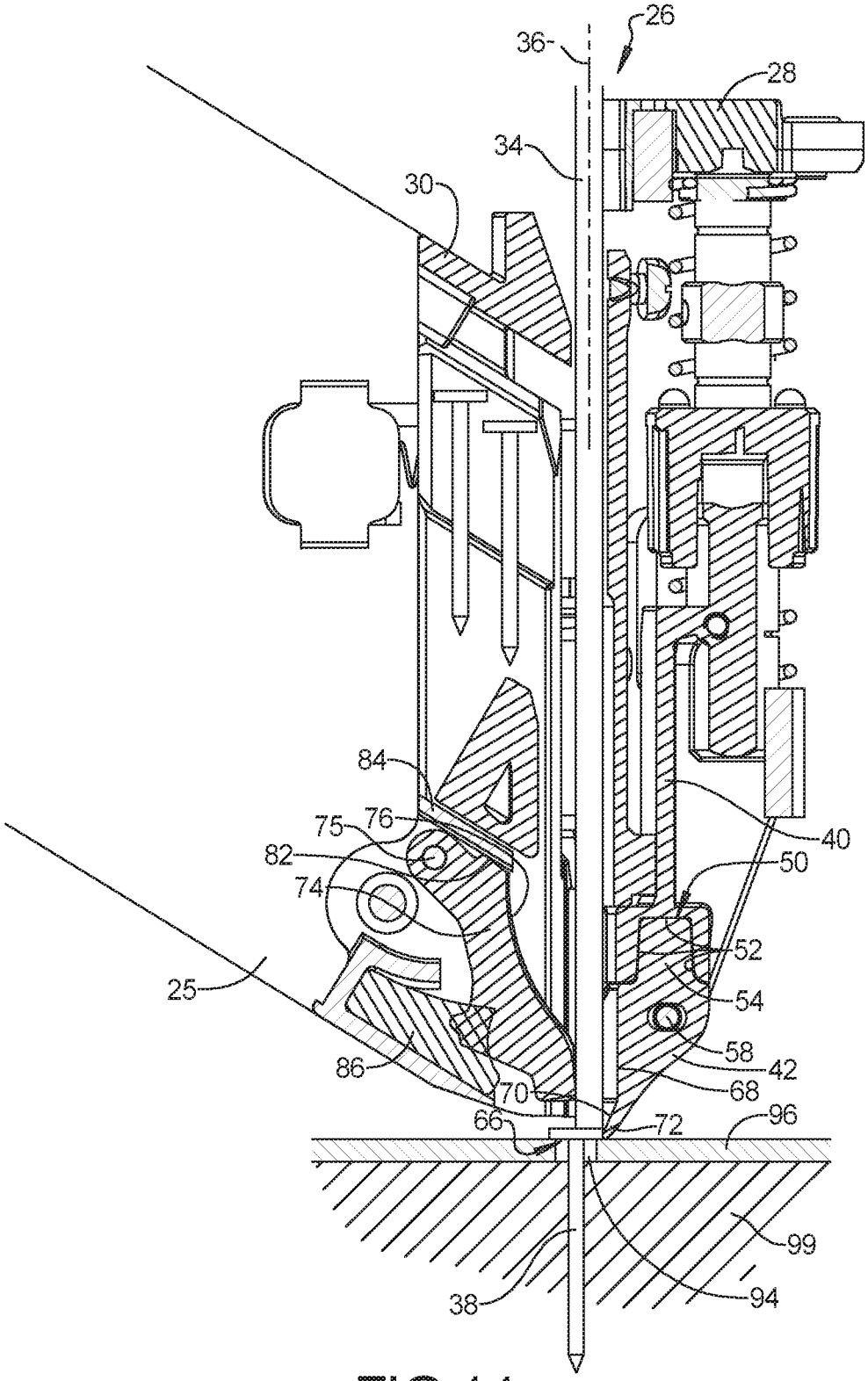
FIG. 14 is a cross section view similar to FIG. 13, but showing the nail driver fully extended and engaging the nail tip lifter.

A nail tip lifter 74 can be pivotably coupled to the rear nail guide housing 30 for pivotable movement between a first position adjacent the positioning tip 42 (FIG. 9) and a second position away from the positioning tip 42 (e.g., FIGS. 13 and 14). The nail tip lifter 74 defines a lifter nail guide groove 76. The lifter nail guide groove 76 starts at a proximal end or start end 78 and extends to a distal end or terminal end 80.

The nail tip lifter 74 can have a projecting stop 82 that engages against a cooperating stop 84 of the rear nail guide housing 30. Engagement of the stops 82, 84 can position the nail tip lifter 74 in non-contacting relationship to the replaceable positioning tip 42 when the nail tip lifter is in the first position. The stop 82 of the nail tip lifter 74 can be positioned away from the positioning tip 42. The stop 82 can be positioned adjacent the proximal end 78 of the rear guide groove 76.

A biasing member 86 can be positioned between the rear nail guide housing 30 and the nail tip lifter 74 to bias the stop 82 against the corresponding of cooperating stop 84 when the nail tip lifter 74 is in the first position (FIG. 9). The biasing member 86 can be a resilient foam material. For example, the resilient foam material forming the biasing member 86 can be a microcellular polyurethane elastomer. One example of such a microcellular polyurethane elastomer is sold under the trade name Celasto® and can be purchased from BASF, Lemforde, Germany.

The lifter guide groove 76 of the nail tip lifter 74 can have an initial concave arc portion 88 extending from the proximal end 78 of the groove 76. The lifter guide groove 76 can have a terminal straight portion 90 extending from and adjacent the distal end 80 of the groove 76. An intermediate convex transition portion 92 can be provided between the initial concave arc portion 88 and the straight portions 90.

In some cases, the length of the intermediate convex transition portion 92 along a center line of the lifter guide groove 76 can be between about 1 and 2 times the length of the terminal straight portion 90. In some cases, the length of the initial concave arc portion 88 along a center line of the lifter guide groove 76 can be at least 3 times, at least 4 times, and at least 5 times the length of the terminal straight portion 90 of the of the rear guide groove 76. Alternatively or additionally, the radius defining the initial concave arc portion 88 can, in some cases, be from about 25 mm to about 35 mm.

The tip lifter 74 can be pivotably mounted to the rear nail guide housing 30 via a pivot pin 75. The distal end 80 of the lifter nail guide groove 76 and of the tip lifter 74 can be positioned closer to the tapered distal end 70 of the positioning tip 42 when the trip arm 40 is in the retracted trip position (FIG. 10), than when the trip arm 40 is in the extended non-trip position (FIG. 9).

FIG. 10 shows the positioning tip 42 located within a fastener or nail aperture 94 of a metal framing component 96 and with the trip arm 40 in the extended, non-trip position. When the trip arm 40 is in this extended, non-trip position, the nail driving tool 20 will not operate to drive a nail 38 down the nail driving path 32, even when the trigger 98 of the nail driving tool is depressed.

Figure 11:
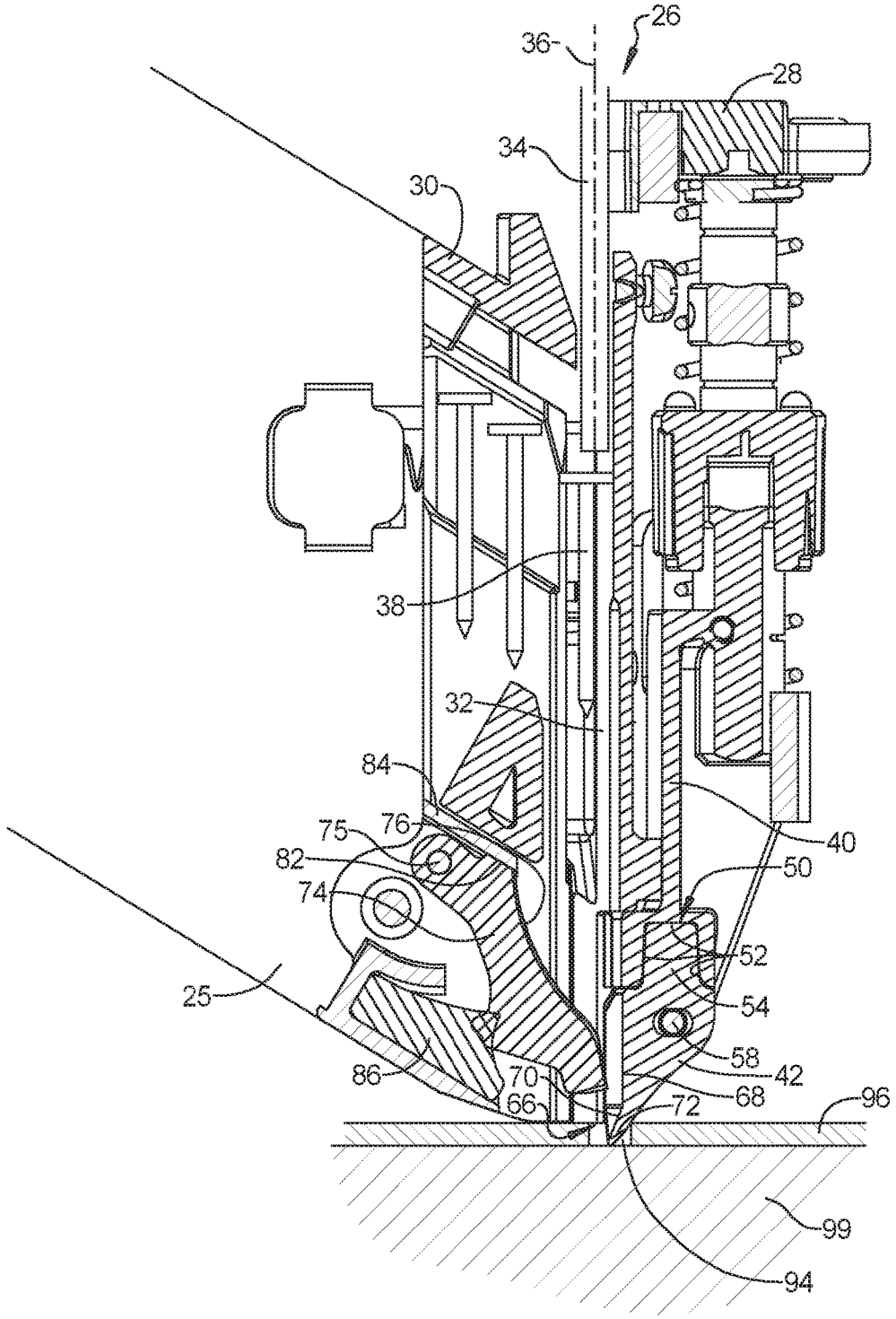
FIG. 11 is a cross section view similar to FIG. 10, but showing the trip arm in the retracted, trip position.

FIG. 11 shows the positioning tip 42 located within a fastener or nail aperture 94 of a metal framing component 96 and with the trip arm 40 in the retracted, trip position. When the trip arm 40 is in this retracted, trip position, the nail driving tool 20 will operate to drive a nail 38 down the nail driving path 32 when the trigger 98 of the nail driving tool is also depressed.

Figure 12:
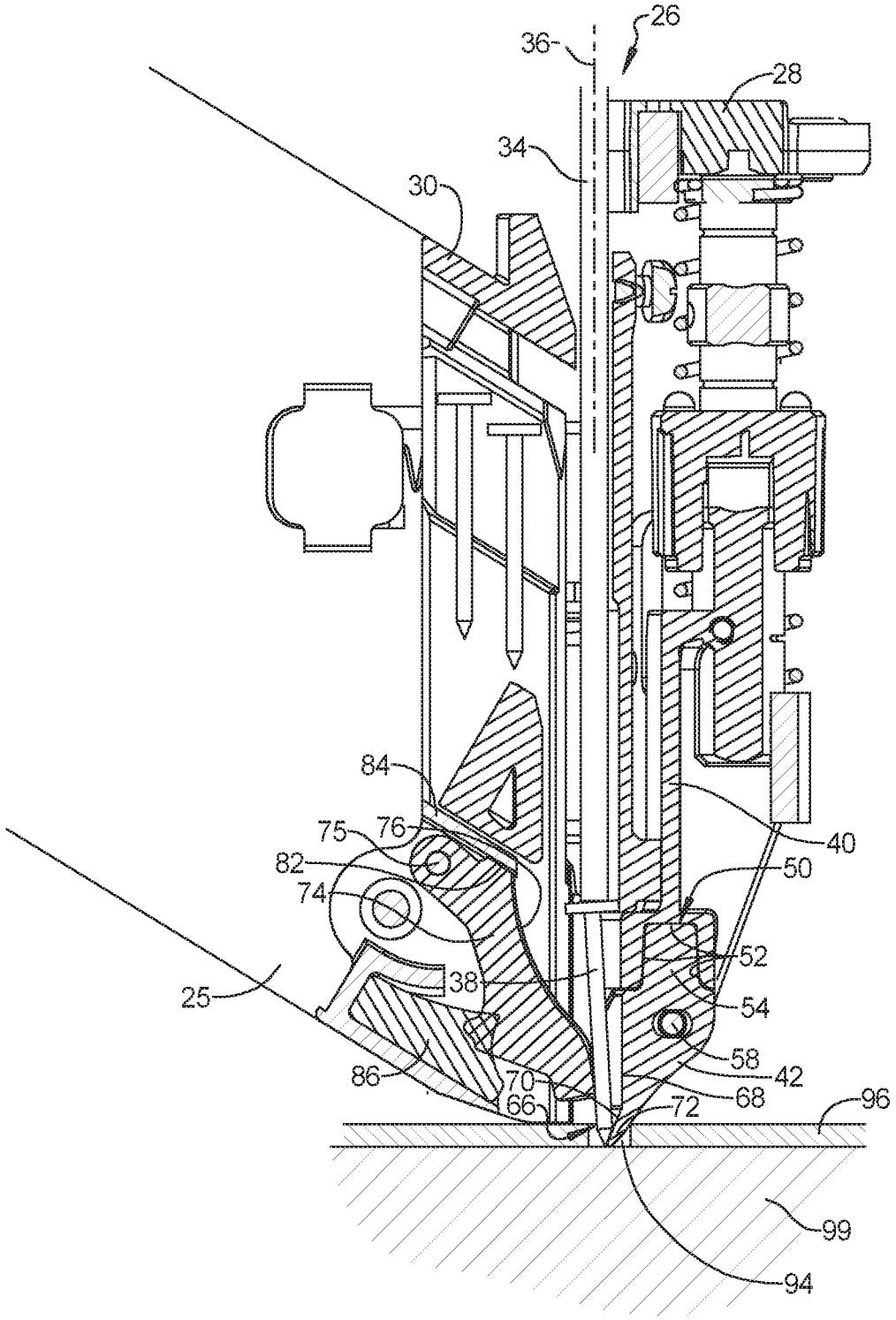
FIG. 12 is a cross section view similar to FIG. 11, but showing the nail initially positioned within the aperture of the metal framing component.

FIG. 12 shows a nail 38 that has been driven down the nail driving path 32 to a position where the pointed tip of the nail 38 is aligned with, or engaging, the tapered. Along the way, the nail has been guided initially by the forward and rear nail guide housings, 28 and 30, respectively, and further by the opposing tip nail guide groove 66 and lifter nail guide groove 76 of the positioning tip 42 and the nail tip lifter 74, respectively. The resilient foam biasing member 86 has been found to be a particularly robust and effective biasing member 86 to sufficiently bias the tip lifter 74 toward the positioning tip 42 to minimize the chance that any wayward pointed tip of the driven nail 38 is lifted to engage against the positioning tip nail guide groove 76 and its tapered distal end 70. This helps insure very precise positioning of the driven nail 38. Because the positioning tip 42 was positioned within the aperture 94 when the trigger 98 was depressed, the driven nail 38 is properly positioned within the aperture 94 of the metal framing component 96.

FIG. 13 shows the nail head 39 and/or nail driver 34 initially engaging the nail tip lifter 74. As the nail head 39 and nail driver 34 continues its downward movement, the nail tip lifter 74 is moved further from its first position away from the positioning tip 42 and toward its second position. FIG. 14 shows this continued movement of the nail tip lifter 74 into its second position as the nail driver 34 is fully extended and the nail 38 if fully driven through the nail aperture 94 and into the wooden framing member 99 with the nail head 39 fully engaged against the metal framing component 96.

Figure 15:
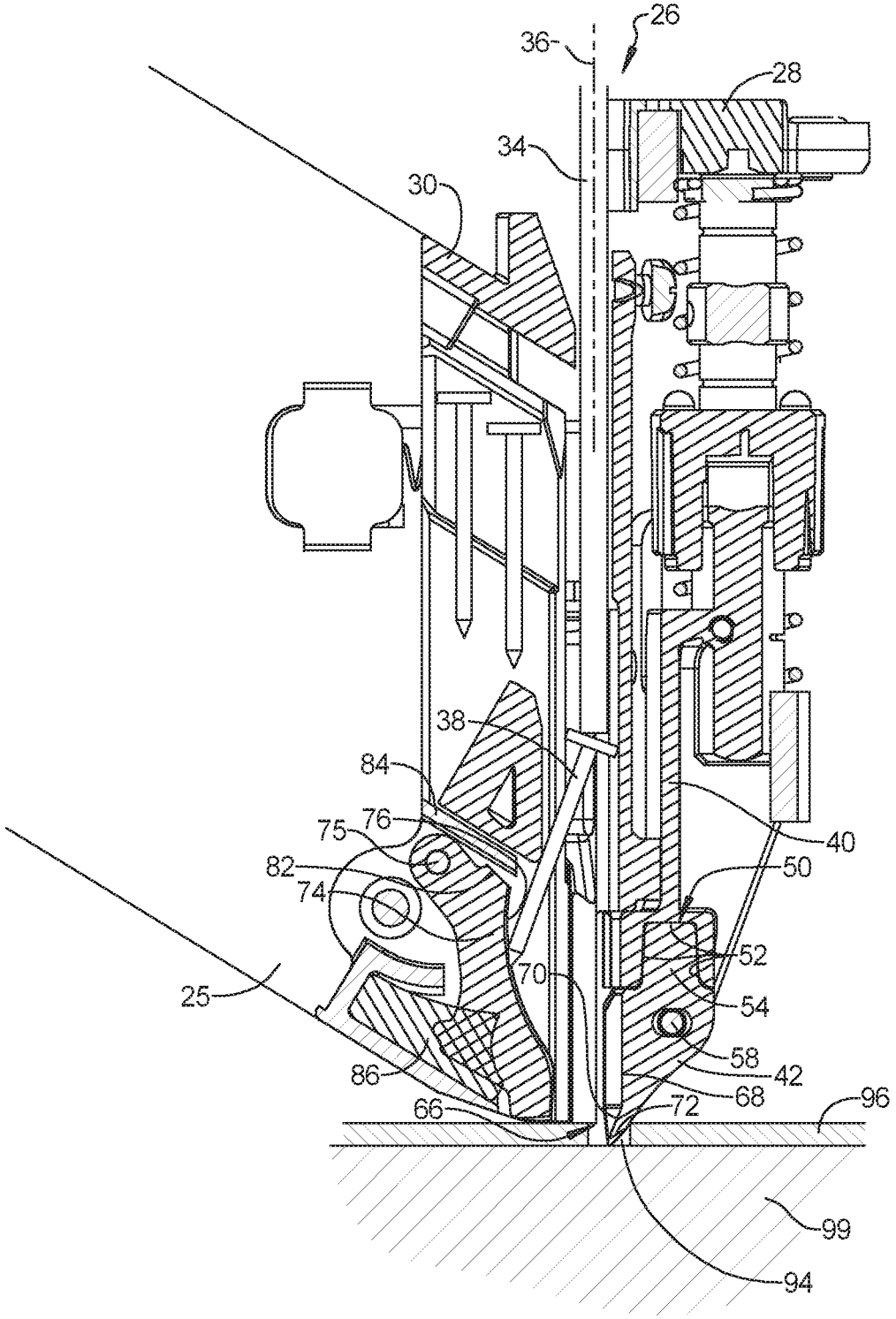
FIG. 15 is a cross section view similar to the previous figures, but showing a nail tip of an angled nail engaging the nail tip lifter prior to the nail tip lifter repositioning the nail tip against the replaceable positioning tip.

FIG. 15 shows a driven nail that has wandered or tumbled out of alignment with the nail driver axis 36 or with the corresponding axis of the nail driving path 32. The arcuate shape of the lifter nail guide groove 76 has been found to be particularly effective at redirecting the driven nail 38 back into alignment with the nail driver axis 36 and against the positioning tip 42 and into the tip nail guide groove 66 as previously described.

For example, the concave arc portion 88 of the lifter nail guide groove 76 extends from the inception, or proximal end 78 of the groove 76 and is relatively long, with only a relatively short convex transition portion 92 and straight portion 90. This shape maximizes the possibility that any such wayward nail 38 will engage the concave arc portion 88. This concave arc portion 88 as described above, has been found to be particularly effective at redirecting any such wayward nail 38. In essence, the only other portion of the lifter nail guide groove 76 that a wayward nail 38 could initially contact is the relatively short convex transition portion 92. Because the convex transition portion 92 is short and limited to a position very close to or adjacent the positioning tip 42, in the event a wayward nail 38 should initially strike the lifter nail guide groove 76 here, it would be in need of only a relatively small amount of repositioning, which the convex transition portion 92 is capable of doing.

Should the positioning tip 42 become damaged or otherwise in need of replacement, the rubber grommet 64 can be removed from the retention groove 59 of the pin 58 retaining the positioning tip 42 on the trip arm 40. Then, the pin 58 can be removed from the apertures 60, 62. The positioning tip 42 can then be removed by pulling it axially out of the tip-receiving channel 46. This axial movement of the positioning tip 42 helps minimize interference or engagement with adjacent components during removal and insertion. A replacement positioning tip 42 can then be reinserted into the tip-receiving channel 46 by reversing this process.

Although the terms first, second, third, etc. may be used herein to distinguish various commonly named features, these terms are only used to distinguish between the otherwise commonly named features. Thus, terms such as "first," "second," and other numerical terms when used herein do not imply an importance, sequence or order unless clearly indicated by the context. Thus, a first feature below could be termed a second feature without departing from the teachings of the example embodiments.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description.

What is claimed is:

1. A nail driving tool with a nail placement assembly, the nail placement assembly comprising:

a nose housing assembly including a forward nail guide housing coupled to a rear nail guide housing and defining a nail driving path between the forward and rear nail guide housings;

a nail driver positioned and reciprocally movably along a nail driver axis to drive a nail down the nail driving path;

a trip arm movably coupled to the nose housing assembly and movable between an extended non-trip position and a retracted trip position relative to the nose housing assembly;

a replaceable positioning tip removably fixedly coupled to a distal end of the trip arm, the replaceable positioning tip defining a tip nail guide groove having a proximal portion extending a first angle that is substantially parallel to the nail driver axis and a tapered distal end tapering at a second angle and encompassed by a thin-walled portion of the replaceable positioning tip;

a nail tip lifter pivotably coupled to the rear nail guide housing for pivotable movement between a first position adjacent the positioning tip and a second position away from the positioning tip, the nail tip lifter defining a lifter nail guide groove extending from a proximal end to a distal end of the lifter nail guide groove; and a biasing member positioned between the rear nail guide housing and the nail tip lifter and biasing the nail tip lifter toward the first position.

2. The nail driving tool with a nail placement assembly of claim 1, wherein the biasing member is a resilient foam material.

3. The nail driving tool with a nail placement assembly of claim 2, wherein the resilient foam material is a microcellular polyurethane elastomer foam material.

4. The nail driving tool with a nail placement assembly of claim 1, wherein the lifter guide groove of the nail tip lifter has an initial concave arc portion extending from the proximal end of the groove and a terminal straight portion extending from and adjacent the distal end of the lifter guide groove and an intermediate convex transition portion between the concave arc and straight portions.

5. The nail driving tool with a nail placement assembly of claim 4, wherein a length of the initial concave arc portion is at least three times a length of the terminal straight portion of the of the lifter guide groove.

6. The nail driving tool with a nail placement assembly of claim 4, wherein a radius defining the initial concave arc portion is from about 25 mm to about 35 mm.

7. The nail driving tool with a nail placement assembly of claim 1, wherein the nail tip lifter has a stop positioned away from the positioning tip and adjacent the proximal end of the lifter guide groove, and wherein the stop engages against a cooperating stop of the rear nail guide housing to position the nail tip lifter in non-contacting relationship to the replaceable positioning tip when the nail tip lifter is in the first position, and wherein the biasing member biases the stop against the corresponding stop when the nail tip lifter is in the first position.

8. The nail driving tool with a nail placement assembly of claim 1, wherein a distal end of the trip arm comprises a tip-receiving channel, and wherein the positioning tip comprises an extension friction fit into the tip-receiving channel.

9. The nail driving tool with a nail placement assembly of claim 8, wherein the positioning tip comprises at least one positioning surface engageable against at least one corresponding positioning surface of the trip arm.

10. The nail driving tool with a nail placement assembly of claim 9, wherein the at least one positioning surface of the positioning tip is provided by three sides of a tab of the extension, and the at least one corresponding positioning surface of the trip arm is provided by three corresponding sides of a tab slot of the channel.

11. The nail driving tool with a nail placement assembly of claim 8, further comprising a removable pin extending through aligned apertures through the tip- receiving channel and through the positioning tip extension.

12. The nail driving tool with a nail placement assembly of claim 11, further comprising a rubber grommet retaining the removable pin in the aligned apertures.

13. The nail driving tool with a nail placement assembly of claim 1, wherein the distal end of the lifter nail guide groove is positioned closer to the distal end of the positioning tip when the trip arm is in the retracted trip position, than when the trip arm is in the extended non-trip position.

14. The nail driving tool with a nail placement assembly of claim 1, wherein the second angle of the tapered distal end of the tip nail guide groove is from about 5 degrees to about 8 degrees relative to the nail driver axis.

15. The nail driving tool with a nail placement assembly of claim 1, wherein a thickness of the thin-walled portion encompassing the tapered distal end of tip nail guide groove and adjacent the proximal portion is less than a maximum depth of the proximal portion of the tip nail guide groove.

16. The nail driving tool with a nail placement assembly of claim 1, wherein a thickness of the thin-walled portion encompassing the distal end tapers from a first thickness adjacent the proximal portion of the tip nail guide groove to a second thickness smaller that the first thickness away from the proximal portion of the tip nail guide groove.

17. The nail driving tool with a nail placement assembly of claim 1, wherein an axial length of the tapered distal end of the tip nail guide groove is less than 25% of an aligned axial length of the proximal end of the tip nail guide groove.

18. The nail driving tool with a nail placement assembly of claim 1, wherein the nail driving tool is a framing nailer.

19. The nail driving tool with a nail placement assembly of claim 1, wherein the nail driving tool is a cordless nailer further comprising a 40 volt or greater battery.

20. The nail driving tool with a nail placement assembly of claim 1, wherein the nail driving tool is a cordless nailer further comprising a 60 volt or greater battery.

* * * * *